United States Patent [19]

Mochiki et al.

[11] Patent Number: 5,058,350

[45] Date of Patent: Oct. 22, 1991

[54] EXPANSION JOINT APPARATUS

[75] Inventors: Yuuichi Mochiki, Nara; Muneo Kamoto, Osaka, both of Japan

[73] Assignees: Nippon Aluminium Mfg., Co., Ltd., Osaka; Nippon Aluminium Kenzai Co., Ltd., Aichi, both of Japan

[21] Appl. No.: 393,764

[22] Filed: Aug. 14, 1989

[30] Foreign Application Priority Data

Aug. 13, 1988 [JP] Japan ..... 63-107330[U]

[51] Int. Cl.[5] ..... E04B 1/62

[52] U.S. Cl. ..... 52/396; 52/573; 404/52

[58] Field of Search ..... 52/396, 403, 573, 109; 404/47, 52, 74

[56] References Cited

U.S. PATENT DOCUMENTS 3,648,423 3/1972 Cole ..... 52/573 X 3,797,952 3/1974 Pommerening et al. ..... 52/396 X 4,557,082 12/1985 Dunsworth ..... 52/396 X

*Primary Examiner*—David A. Scherbel

*Assistant Examiner*—Creighton Smith

*Attorney, Agent, or Firm*—Wenderoth, Lind & Ponack

[57] ABSTRACT

Disclosed is an expansion joint apparatus comprising cover plates disposed on two bodies installed across a gap, in a manner openable by hinges, wherein each cover plate is inclined inward of the gap. The sectional shape of the two cover plates in a combined state is approximately in a V-shape. Each cover plate is thrust with a spring in a direction so that each end may approach that of the other, rotating about the hinge as the center. The angular dislocation of each cover plate is limited to the outer side of the gap, thereby always filling up the gap by opening and closing the cover plates in response to a changing gap, if the gap of two bodies should vary, because the cover plates are disposed on the bodies in a manner free to open and close.

16 Claims, 10 Drawing Sheets

Fig. 5 (1)
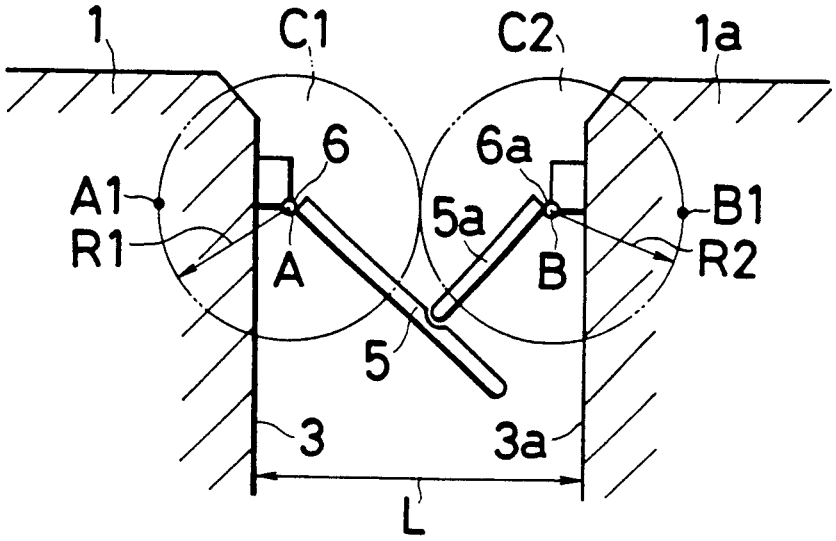
Fig. 5 (2)
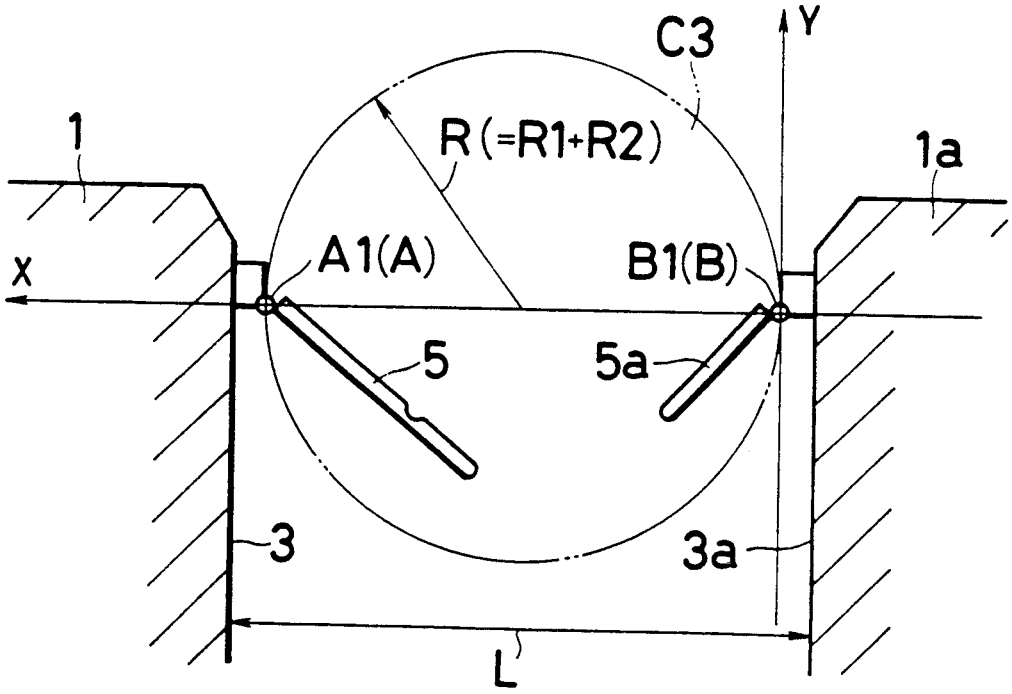

101
8
COVER PLATE
125
128
151
126
131
K2
132
117
118
124
COVER PLATE
116
122
121
104
S2
D10
143
145
142
138
135
122a
103
121a
137
139
136
106a
133
134
104a
102a
100a
S1
K1
115
123
L
112
109
102
100
107
105
108
110
106
114
111
131b
150
119
130
D20
144
129
127
141
140
124a
200
113
120

EXPANSION JOINT APPARATUS

BACKGROUND OF THE INVENTION

1. Field of the Invention

The present invention relates an expansion joint apparatus capable of filling up the mutual gap of bodies and preventing mutual interference, corresponding to earthquake or unequal settling of ground, and changes in the expansion and contraction of bodies, by mutually joining bodies of a building structure or the like.

2. Description of the Prior Art

In a typical prior art, basically, on the upper part of a junction end to be bonded possessing a mutual gap of bodies of a building structure or the like, a concave part is formed along the longitudinal direction of the gap, and a supporting member is fixed, and a slidable cover plate is disposed on this supporting member, thereby filling up the mutual gap of the bodies.

In such a prior art, the cover plate is slidably disposed on the supporting member, and the gap varies over the course of time course due to expansion or contraction of the bodies or settling of the ground. Where the change is not so significant, it is designed to support the cover plate at a position deviated by the supporting member, but in modern high-rise buildings and large structures where the gap may be instantly dislocated greatly due to earthquake or the like, the cover plate may be dislocated from the supporting member, which cannot be coped with by the prior art.

Besides, hitherto, the gap was covered with a lid from the top, and the appearance was consequently large in size.

SUMMARY OF THE INVENTION

It is hence a primary object of the invention to present an expansion joint apparatus capable of always filling a gap and reduced the appearance size as far as possible, even if the gap is larger than the gap of the bodies, due to expansion, contraction or settling of the ground, and changes instantly.

To achieve the above object, the invention presents an expansion joint apparatus, comprising cover plates disposed on two bodies installed across a gap, in a manner openable by hinges. Each cover plate is inclined inwardly of the gap, and the sectional shape of these two cover plates in a combined state is approximately in a V-shape. Each cover plate is thrust with a spring in a direction so that each end may approach toward the other, rotating about the hinge as a center. A means for limiting the angular dislocation of each cover plate to the outer side of the gap is provided.

According to the invention, since the cover plates are openably mounted on the bodies, if the gap of the two bodies should vary, the gap may always be filled up as the cover plates open and close, depending on the changing gap.

Further according to the invention, since a cover plate capable of adjusting the angular dislocation is disposed on at least one of the two bodies installed at a gap, if the gap of the bodies should vary due to earthquake or the like, the gap may be filled up. As a result, invasion of wind or rain into the gap of the bodies is prevented. Besides, since all parts are incorporated within the gap, the appearance is small and neat, not expanding widely.

Preferably, each cover plate is disposed on the supporting member affixed to the two bodies through the hinge.

More preferably, the supporting member possesses a support part fixed to the body, and an engaging part continuous to this support part and extending to the outer side of the gap. The support part has one end of the spring fixed at the inner side of the gap, while the other end elastically abuts against the spring receiving plane formed at the inner side of the gap of the cover. By this spring the cover plate is thrust from the inner side of the gap to the outer side, rotating about the hinge as the center.

More preferably, in the support part, a fitting piece is attached to the outer side of the gap, and the cover plate is fitted to this fitting piece through the hinge.

More preferably, the angular dislocation limiting means is designed to limit the angular dislocation from the inner side of the limit to the outer side, rotating about the hinge as the center, at an inclination angle nearly equal to the inclination angle of the outer wall of the cover plate.

More preferably, the angular dislocation limiting means is a chain disposed at the inner side of the gap from the hinge, and its one end is stopped to the body, while the other end is stopped on the cover plate.

More preferably, in either one of the cover plates, a stopping groove in which the vicinity of the front end part of the other cover plate fits is formed, and in this stopping groove is disposed a packing against which the vicinity of the front end of the other cover plate abuts.

More preferably, the vicinity of the front end of the cover plate abutting against the packing is shaped in an arc.

More preferably, in the state of the angular dislocation rotating about the hinge as the center being blocked by the limiting means, the cover plate and the inner surface of the body are formed nearly flush by way of a step difference part of the cover fitted to the supporting member from the outer side of the gap, and the step difference part is formed smaller than the radius of the front end part of the cover.

More preferably, the step difference part of the cover is filled up with a sealing material from the inner surface of the body to its cover.

More preferably, the spring is fixed to the body at its base end portion and is continuous to the base end portion and curved outwardly to the inner side of the gap, while the free end portion is provided slidably on the inner surface of the cover plate.

The invention also presents an expansion joint apparatus comprising cover plates disposed on two bodies installed at a gap so as to fill up the gap, wherein at least one of the cover plates disposed on the bodies is openably by a hinge, and is thrust toward a direction of filling up the gap by angularly dislocating toward the inner side or outer side of the gap at its front end portion about the axial line of the hinge.

Preferably, the one cover plate comprises a cover part being nearly flush with the outer surface of the body to which the other cover plate is fitted, and a support part continuous to the cover part and inclined in a direction of nearing the body to which the other cover plate is fitted as going inward of the gap.

More preferably, the front support part comprises a first inclination part continuous to the cover, a step difference part continuous to the first inclination part and stretching toward the body to which the other cover plate is fitted, and a second inclination part continuous to this step difference part.

More preferably, the extreme end portion of the support part toward the body to which the other cover plate is fitted is spaced at a distance S1 from the inner surface of the other body, and the extreme end portion K2 of the front end portion of the other cover plate toward the body to which the other cover plate is fitted is spaced at a distance S2 from the inner surface of the other body.

More preferably, the cover plates fitted on the two bodies are respectively disposed on supporting members, and the supporting members are fixed to the bodies at the inner side of the gap from the cover plates.

BRIEF DESCRIPTION OF THE DRAWINGS

The above and other objects of the invention, as well as the features and advantages thereof, will be better understood and appreciated from the following detailed description taken in conjunction with the drawings, in which.

DETAILED DESCRIPTION OF THE PREFERRED EMBODIMENTS

Figure 1:
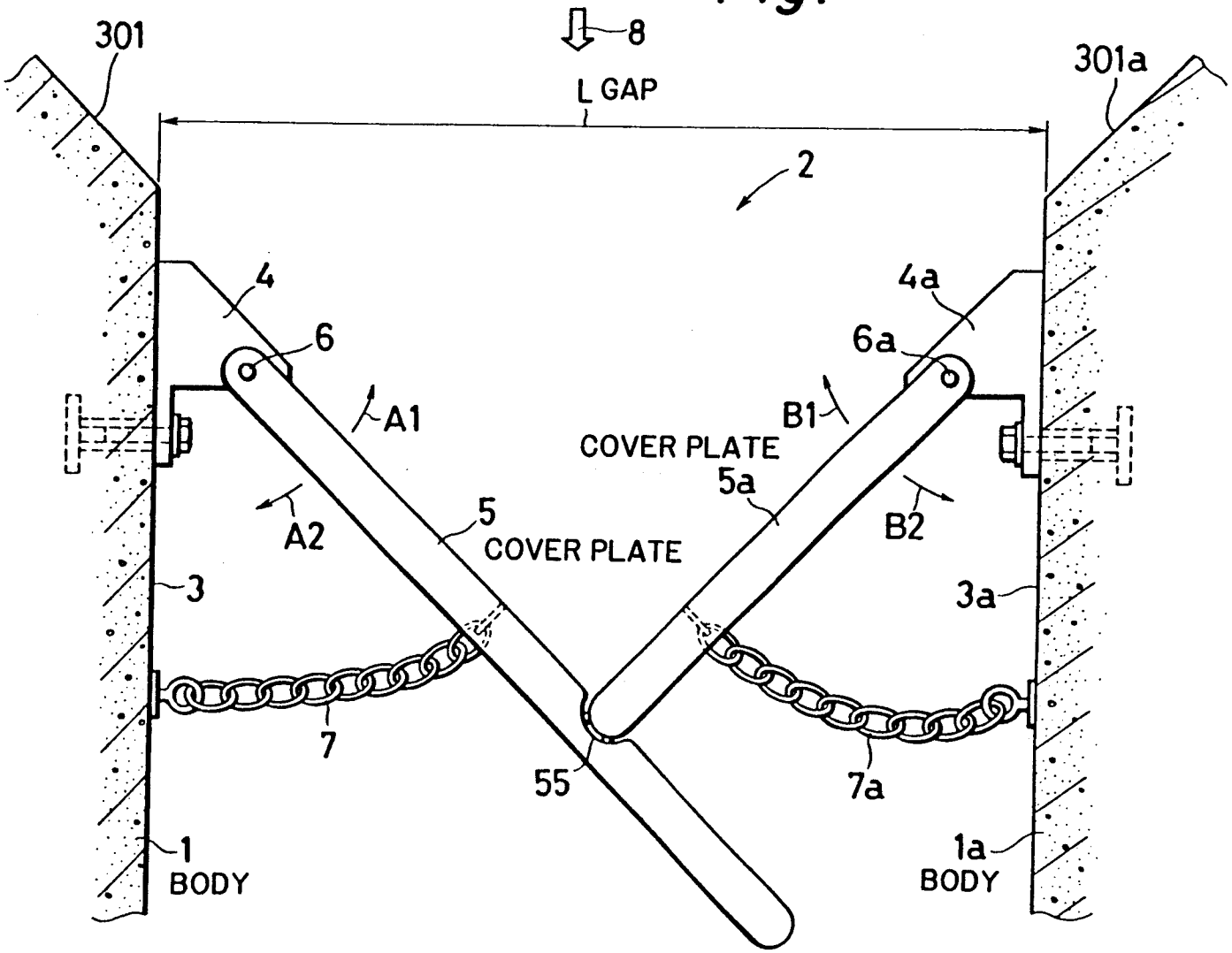
FIG. 1 is a horizontal sectional view showing a first embodiment of the invention.

Referring now to the drawings, some of the preferred embodiments of the invention are described in detail below.

FIG. 1 is a horizontal sectional view showing an approximate structure of an embodiment of the invention. Bodeis 1, 1*a* such as building structures are disposed at a mutual gap of L, and between these bodies 1, 1*a*, an expansion joint apparatus 2 according to the invention is provided. On the mutually opposing inner surfaces 3, 3*a* of the bodies 1, 1*a*, supporting members 4, 4*a* are fixed, respectively. On the supporting members 4, 4*a*, cover plates 5, 5*a* are mounted so as to be free to dislocate angularly about the axial lines of hinges 6, 6*a*. To these cover plates 5, 5*a*, chains 7, 7*a* are fitted on one end, of which other end is fitted to the bodies 1, 1*a*, which prevents undesired angular dislocation in the direction of arrows A1, B1 about the axial lines of the hinges 6, 6*a*.

By such an expansion joint apparatus 2, the relatively large gap L of, for example, about 0.5 m may be filled up. In the event of an earthquake, if the bodies 1, 1*a* are dislocated, and the gap 1 changes, the free end of the cover plate 5*a* keeps in contact with the other cover plate 5 and angularly dislocates about the axial lines of the hinges 6, 6*a*, so that the gap L may be always filled up depending on the changes.

Figure 2:
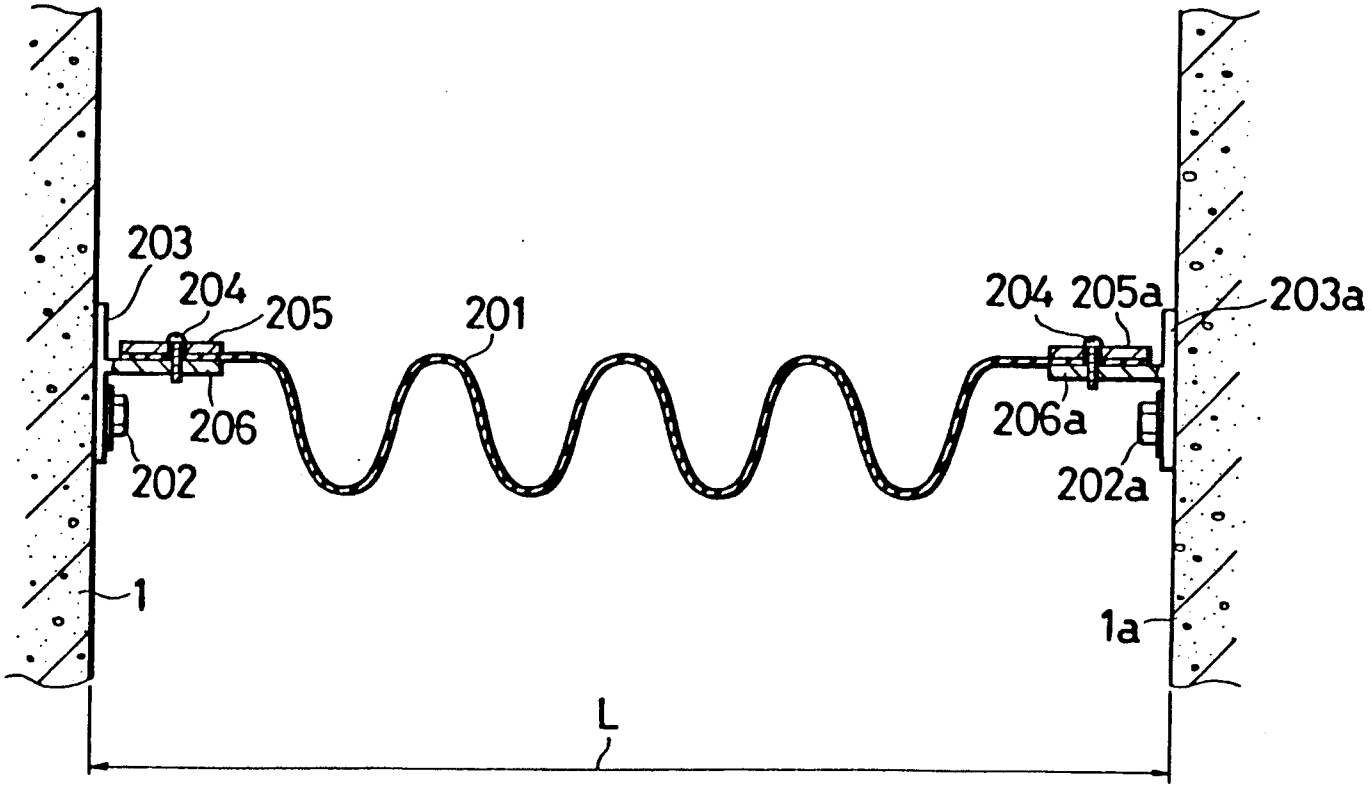
FIG. 2 is a sectional view showing the mounted state of a water stop 201.

Inward of such gap L (downward in FIG. 1), a water stop 201 made of neoprene or similar material as shown in FIG. 2 is disposed. Both ends of the water stop 201 are held and supported by brackets 203, 203*a* fixed to the bodies 1, 1*a*, by bolts 202, 202*a*, and holding members 205, 205*a*, fixed to the brackets 203, 203*a* screws 204, 204*a*. By installing such a water stop 201, the invasion of wind or rain into the inside of the gap L may be prevented even if a clearance is produced between the cover plates, as described below.

Figure 3:
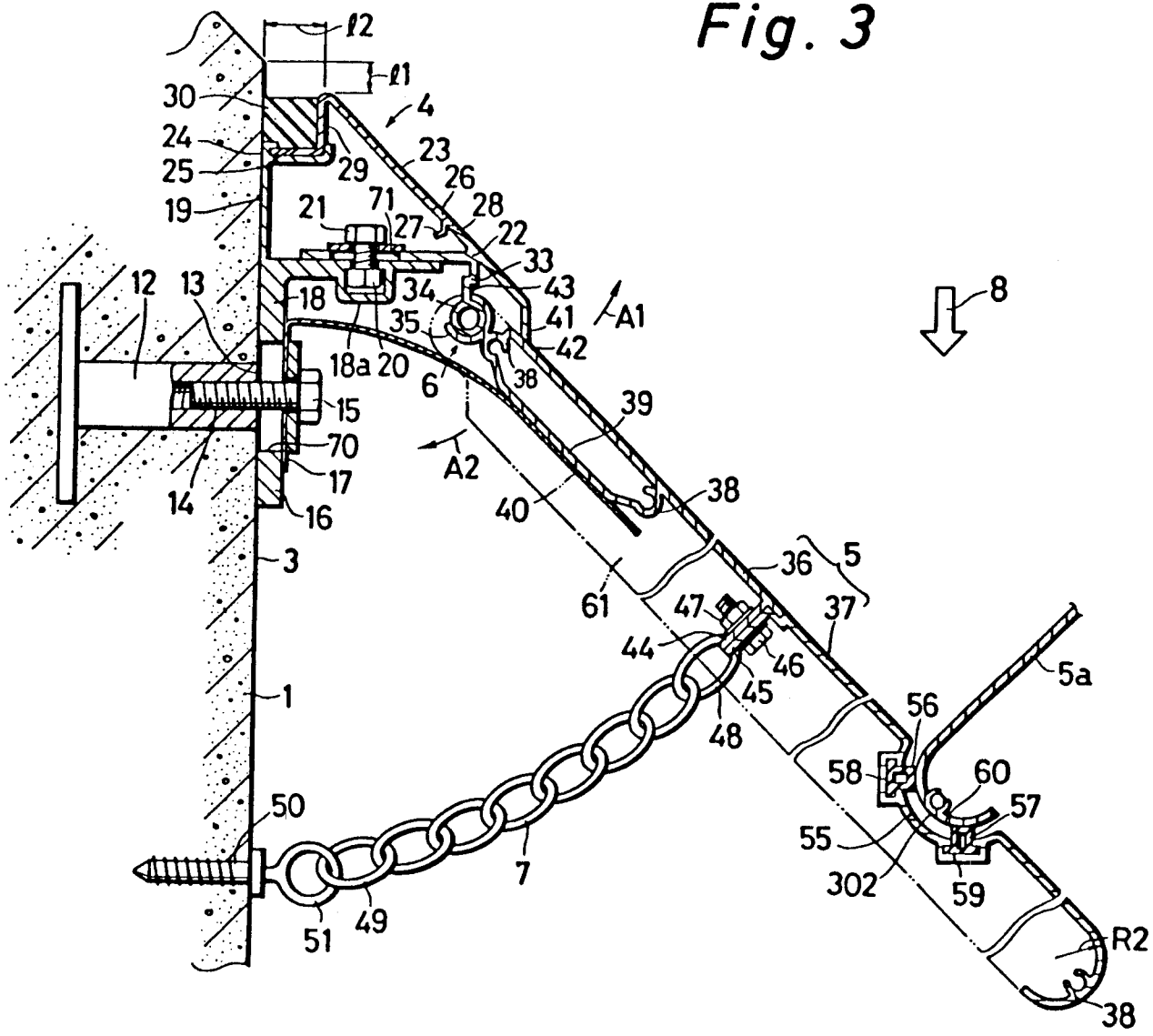
FIG. 3 is an enlarged sectional view showing a practical structure of a cover plate 5 side mounted in relation to the body 1 of an expansion joint apparatus 2.

FIG. 3 is an enlarged sectional view showing a practical structure of the cover plate 5 side installed in relation to the body 1 of the expansion joint apparatus 2. The body 1 is made of, for example, precast concrete, and an insert nut 12 is buried in this body 1. One end 13 of this nut 12 is installed within a plane without projecting from the inner surface 3. In such nut 12, a screw hole 14 is formed, and a bolt 15 is driven in this screw hole 14. By such nut 12 and bolt 15, a bracket 16 and a leaf spring 17 are affixed to a body 17. The spring force of this leaf spring 17 is selected to such as extent that the cover plate 5 is not dislocated angularly within a predetermined wind pressure, for example, to such as extent that the cover plate may slightly dislocate angularly at the maximum wind pressure in two years.

The bracket 16 comprises a support part 18 in an approximately inverted L-shape, and an engaging part 19 continuous to the support part 18 in the upper part of FIG. 3. A slot 70 in which the bolt 15 is inserted is formed in the support part 18, so that the mounting position of the bracket 17 on the body 1 may be dislocated and adjusted in the horizontal direction (in the vertical direction in FIG. 3). A bolt 20 is fitted in a groove 18*a* of the support part 18, and a nut 21 is screwed onto this bolt 20. By such bolt 20 and nut 21, a metal fitting piece 22 made of aluminum or the like is fixed to the support part 18. A slot 71 is formed in this mounting piece 22, so as to be changed in the lateral direction in FIG. 2 with respect to the bracket 16. Hence, even if the inner surface 3 of the body 1 is slightly undulated due to machining error, the mounting position of the fitting piece 22 may be adjusted in three directions.

Above this fitting piece 22 is arranged to cover 23. This cover 23 has one end 25 fitted and stopped into an engaging recess 24 formed in the engaging part 19, while an engaging pawl 27 is formed on the other end 26 so that the engaging pawl 27 may be engaged with an engaging part 28 of the fitting piece 22. Thus, the cover 23 is fitted to the engaging part 19 and the fitting piece 22. Between a bent part 29 continuous to one end 25 of the cover 23 and the inner surface 3 is placed as filler sealing material 30 having tackiness, such as a silicone seal.

To the fitting piece 2, the cover plate 5 is attached by means of the hinge 6 so as to be free to dislocate angularly in the directions of arrows A1, A2. The hinge 6 is a shaft part 34 in a right circular cylindrical shape continuous to a bent part 33, and a receiving tube 35 in an approximately C-shape, and the shaft part 34 is fitted into the receiving tube 35, and the cover plate 5 is supported so as to be dislocatable angularly in the directions of arrows A1, A2.

The cover plate 5 thus supported to be dislocatable angularly is composed of a cover plate part 36 continuous to the hinge 6, and another cover plate part 37 continuous to the cover plate part 36. The cover plate 36 is made of metal such as aluminum, and a spring receiving piece 39 is formed integrally continuous to a tapping hole 38 in an approximately C-shape. The vicinity of a free end portion 40 of the leaf spring 17 elastically abuts against the spring receiving piece 39, and by this the cover plate part 36 is thrust with spring in the direction of the arrow A1. The cover plate part 36 thrust with spring in the direction of the arrow A1 by such leaf spring 17 is arranged so that the surface 42 near the hinge 6 of the cover plate part 36 may hit against the contact part 41 of the fitting piece 22, while the end face 43 of the receiving tube 35 of the hinge 6 may abut against the bent part 33. In this way, the angular dislocation of the cover plate 5 in the direction of the arrow A1 is prevented.

Near the free end portion at the opposite side of the hinge 6 of the cover plate part 36, a coupling piece 44 is formed. This coupling piece 44 abuts against a coupling piece 45 formed in the cover plate part 37. The coupling pieces 44, 45 are fastened with a nut 47 and a bolt 46 inserted into a bolt in the thicknesswise direction. As a result, the cover plate part 36 and the cover plate part 37 are coupled together. In these coupling pieces 44, 45, insertion holes inserting in the thicknesswise direction are formed, and a closed loop ring 48 at one end of the chain 7 is inserted and stopped in this insertion hole. A ring 49 at the other end of the chain 7 is engaged with an engaging part 51 of a bolt 50 for concrete driven into the body 1. By this chain 7, the angular dislocation of the cover plate 5 in the direction of the arrow A1 is also blocked.

A stopping groove 55 in an approximately semi-arc shape is formed an the cover plate part 37, and on the inner surface of this stopping groove 55 are formed engaging grooves 58, 59 to be combined with soft or hard vinyl chloride packings 56, 57. In this stopping groove 55, the vicinity of the free end portion of the other cover plate **5*a* is partly fitted, and the packings 56, 57 abut against an arc-shaped end face 60. In such state, since the cover plate 5 is thrust with spring in the direction of arrow A1 by the spring force of the leaf spring 17, the packings 56, 57 abut elastically against the end face 60, so that the gap between the cover plates 5, 5*a* may be filled up. Accordingly, invasion of wind or rainwater from the direction indicated by reference number 8 may be prevented. If the wind pressure acts, furthermore, it is possible to withstand the wind pressure by the spring thrusting force. Or, due to an earthquake or the like, if the bodies 1, 1*a* are dislocated and the cover plates 5, 5*a* are angularly dislocated due to the change in the gap L, the end face 60 remains in contact with the packings 56, 57, so that invasion of wind or rainwater in the direction indicated by the reference numeral 8** may be prevented.

In such cover plate part 37, too, a tapping hole 38 is formed, as in the cover plate part 36, and in these cover plate parts 36, 37, a lid body 61 stretching parallel to the surface of the sheet of paper in FIG. 3 is mounted in relation to the fitting piece 38.

Besides, relating to the other cover plate **5*a*, by the same structure as in the cover plate 5 explained above, it is mounted so as to be free to dislocate angularly in the directions of arrows B1, B2 around the axial line of the hinge 6*a***, and the explanation is omitted here to avoid repetition.

In the thus composed expansion joint apparatus 2, in the ordinary state as far as the cover plates **5, 5*a* are not dislocated angularly, as shown in FIG. 3, the contact part 41 abuts against the surface 42 in the state of being thrust in the direction of arrow A1 by the leaf spring 17, and the end face 43 of the receiving tube 35 abuts against the bent part 33, so that the angular dislocation in the direction of arrow A1 is blocked. The other cover plate 5*a* is, like the cover plate 5, blocked from angular dislocation in the direction of arrow B1, and in this state the packings 56, 57 abut against the end face 60 of the cover plate 5*a* to prevent invasion of wind and rainwater blowing from the outer side to the inner side of the gap L as indicated by reference numeral 8 in FIG. 1**. At the same time, collision of the two cover plates is prevented.

In this state, if the gap L is narrowed as the bodies **1, 1*a* are dislocated in the mutually approaching directions by earthquake or the like, the cover plate 5 is angularly dislocated in the direction of the arrow A2, while the cover plate 5*a* is angularly dislocated in the direction of arrow B2. In this state, the end face 60 remains in contact with the packings 56, 67**. Thus, if the gap L is changed, the gap may be kept filled up.

Figure 4:
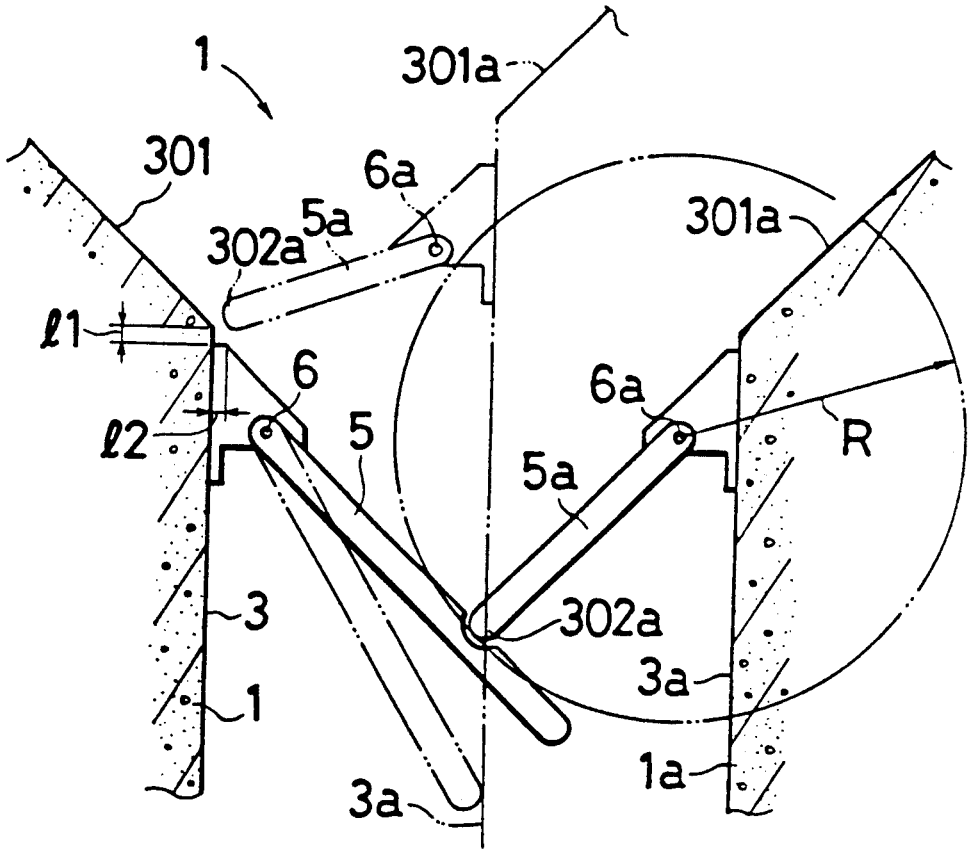
FIG. 4 is a sectional view explaining the operation of the expansion joint apparatus 2, FIGS. 5(1) and 5(2) are simplified sectional views further explaining the operation of the expansion joint apparatus 2.

The operation of the expansion joint apparatus 2 shown in FIGS. 1 to 3 is assumed that the other cover plate **5*a* may move within the virtual circle with radius R shown in FIG. 4 while the cover plate 5 does not move, and at this time in order that the cover plates 5, 5*a* may return to the original position without being damaged, in the embodiment in FIG. 1, the inclination angle of the outer walls 301, 301*a* is about 45 degrees, and therefore the original positions of the cover plates 5, 5*a* are also inclined by about 45 degrees to the inner surfaces 3, 3*a* so as to be nearly equal thereto. In this constitution, the free end portion 302*a* can slide on the wall surface 301, so as to return to the original position promptly. In FIG. 3, if the free end portion 302*a* collides against the step different part of the sealing material 30, it can slide smoothly because the size of the step difference parts l1, l2 is set smaller than the radius R2 of the free end portion 302*a***.

FIG. 5 is a simplified sectional view for further explaining the operation of the expansion joint apparatus 2. Generally, when wind pressure or earthquake should occur, the bodies **1, 1*a* may be assumed to move individually within a range of points A, B at the center of rotation of the hinges 6, 6*a* enclosed by virtual circles C1, C2 with radii R1, R2. These radii R1, R2 are actually less than the gap L/2, but for the convenience of explanation, it is supposed that $R1=R2=L/2$. Within virtual circles C1, C2 having such radii R1, R2, the bodies 1, 1*a* are dislocated to move until the points A, B of the hinges 6, 6*a* to arbitrary positions A1, B1 respectively, when, as shown in FIG. 5(2), the point B1 at the opposite side of the point A1 is at a distance of $2R2+2R2$, being located on the virtual circle C3, so that it is supposed to move within the virtual circle C3 with the radius $R(=R1+R2)$ having the origin at B1**.

Figure 6:
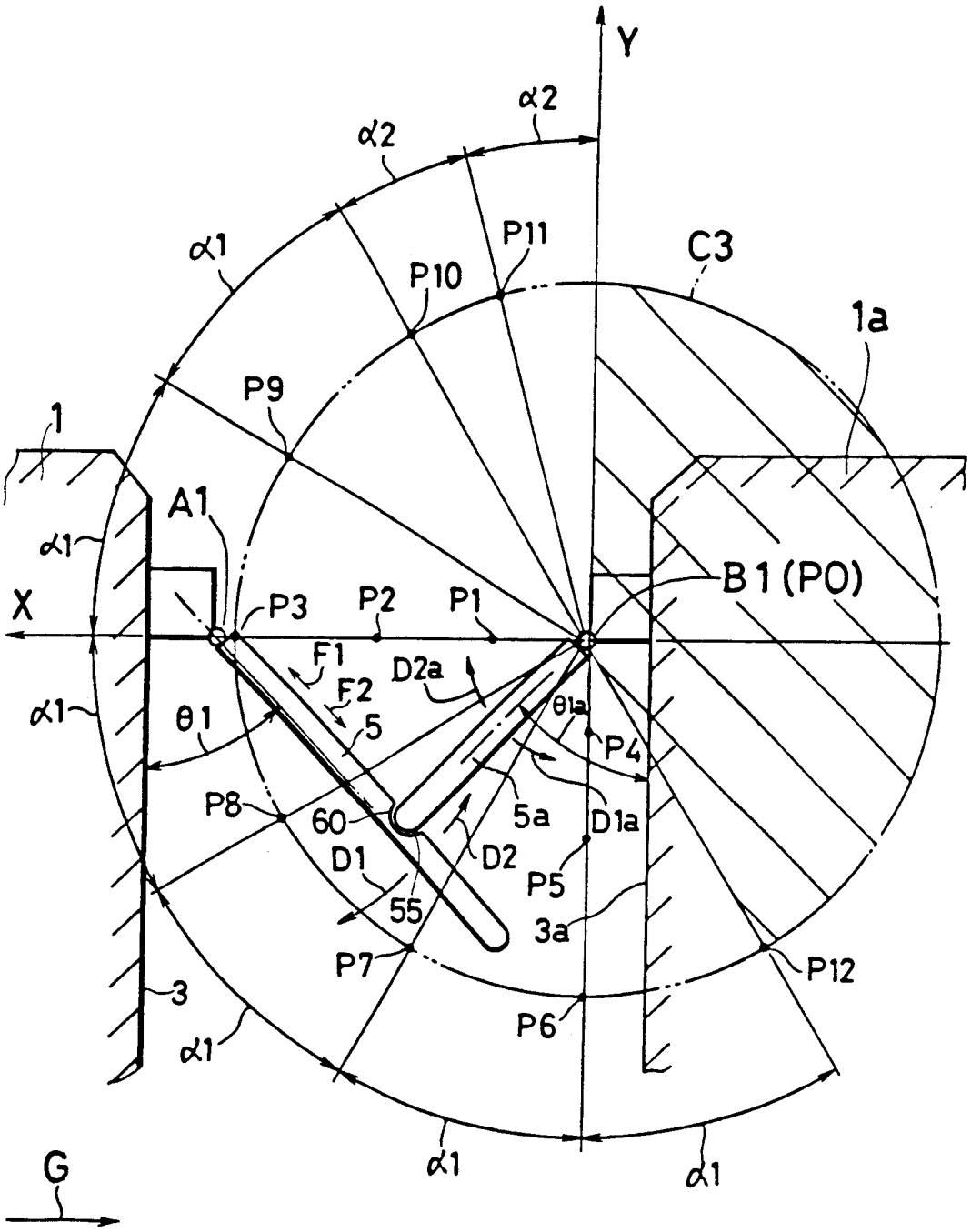
FIG. 6 is a drawing for explaining the operation of cover plates 5, 5*a*.

Accordingly, as shown in FIG. 6, while the body 1 is stationary, the point A1 is located at the origin, and the other body **1*a* is dislocated within the virtual circle C3 having the origin at B1. The cover plate 5 is, normally, stopped by forming an angle $\theta 1=45°$ with respect to the surface 3, and in such state, when the point B1 moves to positions P1, P2, P3 on the circle, the operation of the cover plates 5, 5***a* becomes as follows. By the movement of the point B to positions P1, P2, P3, the cover plates 5, 5*a* are angularly dislocated in the direction of arrows D1, D1*a* while decreasing the angles $\theta 1$, $\theta 1a$, respectively. When moving in the sequence of points P3, P2, P1, meanwhile, the cover plates 5, 5*a* are angularly dislocated in the directions of arrows D2, D2*a* while increasing the angle $\theta 1$, $\theta 1a$, thereby returning to initial position P0.

In such reciprocal motion of the point B1 between positions P1 and P3, while the point B1 is located at other position than position P3, the end face 60 is maintained in a state nearly fitted into the stopping groove 55. When the point B1 moves to positions P4, P5, P6, the cover plates 5, 5*a* are angularly dislocated in the directions of arrows D1, D1*a* while decreasing the angles $\theta 1$, $\theta 1a$, and the vicinity of the end face 60 of the cover plate 5*a* is departed from the stopping groove 55, and moves on the surface of the cover plate 5 in the direction of arrows F1, F2. Thus, the point B1 can move to the positions P4, P5, P6 in a state of filling up the gap L with the cover plates 5, 5*a*.

When the point B1 returns from the position P6 in the direction of positions P5, P4, the cover plates 5, 5*a* are dislocated angularly in the direction of arrow D2, D2*a*, while increasing the angles $\theta 1$, $\theta 1a$, and the end face 60 of the cover plate 5*a* tightly fits into the stopping groove 55 while the point B1 is located at the initial position P0. Furthermore, if the point B1 moves from position P6 to position P7 to P11 along the virtual circle C3, the cover plate 5, 5*a* can be while mutually increasing or decreasing the angles $\theta 1$, $\theta 1a$, so that it is possible to move in a range of angle $\theta 3$ with the initial position P0 as the center, as proved by the experiment of the present inventor. In the shaded area of the virtual circle C3, incidentally, since the cover plates 5, 5*a* do not interfere with each other, it is omitted from the scope of measurement. Relating to the initial position P0, the angle $\alpha 1$ mutually formed by the positions P12, P6 to P19 on the virtual circle C3 is 30°, and the angle $\alpha 2$ formed by positions P10, P11 is 15°.

If the body 1*a* is dislocated in the direction G apart from the body 1, since the cover plates 5, 5*a* are stopped by their respective chains 7, 7*a*, they are hence kept still while keeping the angles $\theta 1$, $\theta 1a$ nearly at 45°. In this state, if the body 1*a* moves in the reverse direction of the arrow G direction, the end face 60 of the cover plate 5*a* is easily engaged in the stopping groove 55 of the cover plate 5 so as to return to the initial position. What is more, at the inner side of the cover plates 5, 5*a* indicated by arrow 8, the water stop 201 is disposed as described earlier, so that invasion of wind or rain to the inner side of the gap L may be prevented even if the cover plates 5, 5*a* are mutually remote from each other as shown in FIG. 5(*a*).

Figure 7:
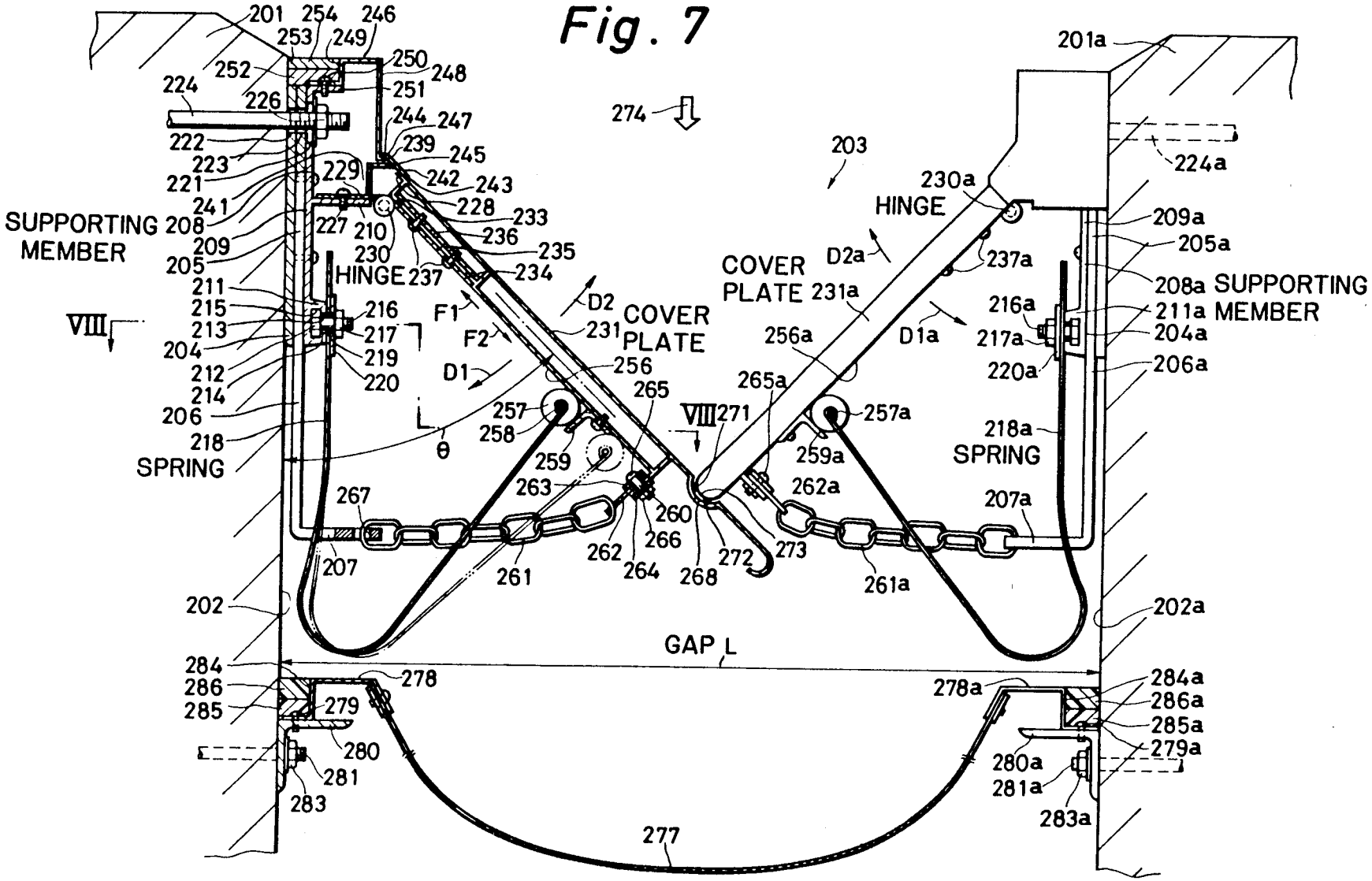
FIG. 7 is a horizontal sectional view of an other embodiment of the invention.
Figure 8:
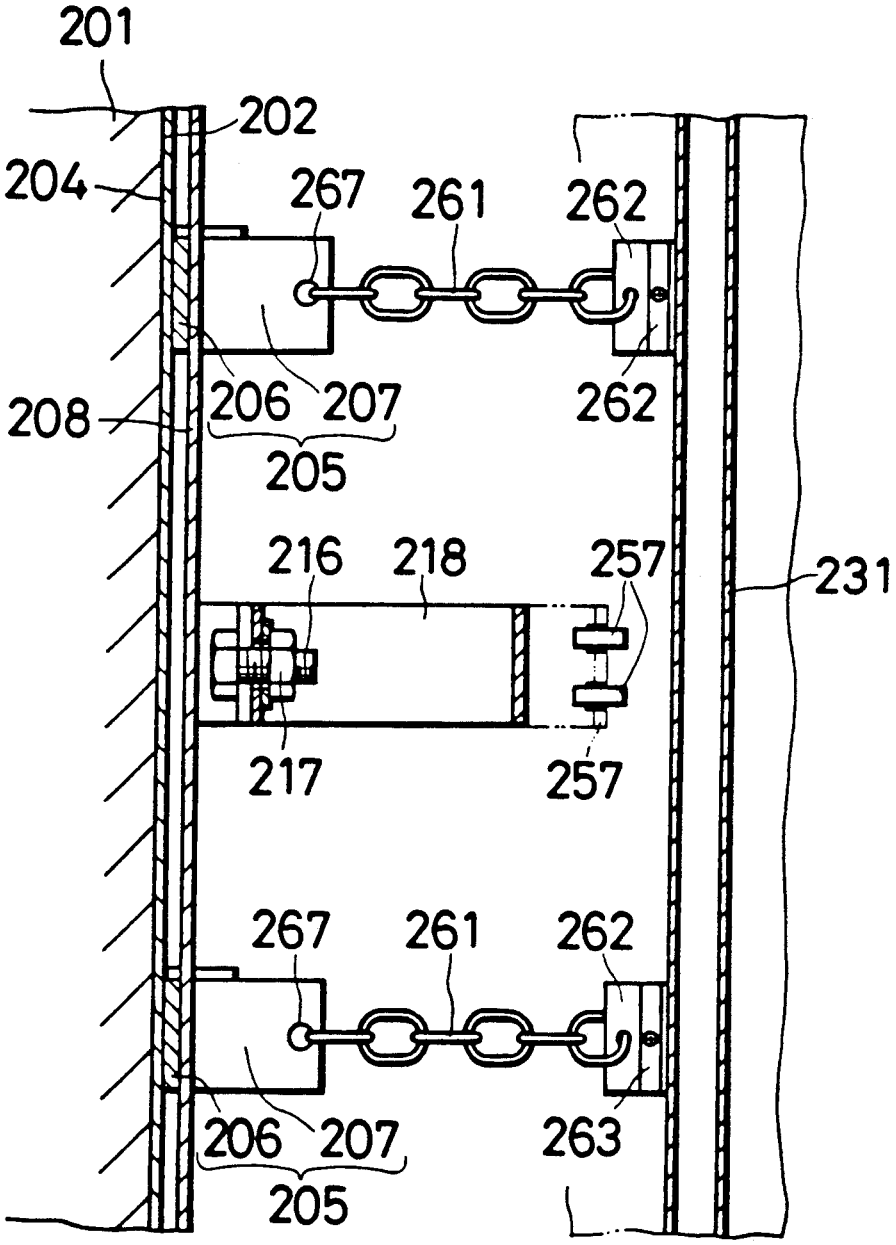
FIG. 8 is a vertical sectional view seen from sectional line VIII—VIII in FIG. 7.

FIG. 7 is a horizontal sectional view of another embodiment of the invention, and FIG. 8 is a perpendicular sectional view seen from sectional line VIII—VIII in FIG. 7. Concrete structure bodies 201, 201*a* such as building structures are disposed at a mutual gap L, and on the mutually confronting surface 202, 202*a* of these bodies 201, 201a, an expansion joint apparatus 203 conforming to the invention is disposed. On the surface 202 of the body 201, an aluminum or iron line 204 stretching in the direction vertical to the surface of the sheet of paper in FIG. 7 is provided, and on the surface of the liner 204, an L-shaped base 205 is disposed in contact. This base 205 is made of iron or stainless steel, and comprises a base part 206 abutting against the liner 204 and a coupling part 207 vertically continuous to the base part 206. Such base 205 is disposed at a clearance in the perpendicular direction (in the direction vertical to the sheet of paper in FIG. 7). On the further inner side of the gap L of the base 205, a supporting member 208 made of aluminum or the like is disposed. This supporting member 208 comprises a flat base part 209 tightly abutting against the base part 206, a fitting piece 210 projecting at the inner side of the gap L from the base part 209, a pair of rise parts 211, 212 standing up from the base part 209 at the same side as the fitting piece 210, and bent parts 213, 214 bent and continuous to the free ends of the rise parts 211, 212. By the base part 209, rise parts 211, 212 and bent parts 213, 214, a groove 215 extending in the direction perpendicular to the sheet of paper in FIG. 8 is formed. In the groove 215, the head of a bolt 216 is fitted, and a spring 218 nearly in V-shape is fixed by a nut 217 fitted to the shaft part of the bolt 216.

In this spring 218, a slot 219 for inserting the shaft part of the bolt 216 is formed, and the shaft part of the bolt 216 fitted to the groove 215 mounts a washer 220 in a state of being inserted in the slot 219. The nut 217 is tightened with a wrench or tightening tool, so that the spring 218 is fixed to the edge material 208. When the nut 217 is loosened, the spring 218 can be dislocated along the longitudinal direction of the slot 219. As a result, the spring force of the spring 218 can be adjusted. Such spring 218 has a relatively large spring force, and it can be mounted from the outer side of the gap.

In the supporting member 208, a slot 221 is formed, and stud bolts 224 are inserted into insertion holes 222, 223 formed in the liner 204 and base 205, and by fitting washers 225 to the bolts 224 and tightening nuts 226, the supporting member 208 is affixed to the body 201 through the liner 204 and base 205. A fixing means is composed comprising these bolts 224, washers 225 and nuts 226. Such fixing means is located at the outer side (upper side in FIG. 7) of the hinge 230 mentioned later.

To the fitting piece 210 of the supporting member 208, a coupling piece 229 is fixed by means of bolt 227. A cover plate 231 is pivoted tot he coupling piece 229 through hinge 230 so as to be free to dislocate angularly in the direction of the arrows D1, D2 around the axial line of the hinge 230. Inward flanges 233, 234 of the cover plate 231 are held by a mounting part 235 extending integrally from the hinge 230, and a holding piece 236 is disposed in the groove at the inner side of the inward flanges 233, 234, being fixed by screws 237. An aluminum-made lower cover 239 abuts against the coupling piece 229 extending integrally from the hinge 230. This lower cover 239 has an inverted L-shaped bent part 241 abutting against the mounting part, and a cover part 242 continuous to the bent part 241. At one end 243 of the cover part 242, the vicinity of an abutting piece 228 formed at the outer side (upper side in FIG. 7) of the cover plate 231 contacts, so that the angular dislocation of the cover plate 231 in the direction of the arrow D2 around the axial line of the hinge 230 is prevented. The other end 244 of the cover 242 forms an engaging recess 245 against the bent part 241, and an engaging pawl 247 of the upper cover 246 is engaged with this engaging recess 245.

The upper cover 246 possesses an inverted L-shaped cover 248 on which the engaging pawl 247 is integrally formed at one end, and a bent part 249 continuous to the inner side of the cover 248. The bent part 249 is screwed to a fitting piece 251 bent and formed integrally at the outer side (upper side in FIG. 7) of the supporting member 208 by screw 250. These upper cover 246 and lower cover 239 are extending in the direction perpendicular to the sheet of paper in FIG. 7.

In a recess groove 253 formed between the bent part 249 of the upper cover 246 and the surface 202 of the body 201, a backup material 252 is charged to fill up, and the outer side is plugged with a sealing material 254 having tackiness such as silicone seal. The backup material 252, sealant material 254 and upper cover 246 are mounted after fixing the supporting member 208 to which the base 205, the spring 218, coil a 261 and cover plate 231 are fitted at the shop, to the surface 202 of the body 201 by the bolts and nuts driven in the body 201 in the field. Thus, since the bolt 221 is located outside of the hinge 230, the nut 226 can be tightened in the state of dismounting the upper cover 246, so that the cover plate 231 and others can be mounted in a sufficiently wide space at the outer side of the body 201.

At the free end portion of the spring 218, a roller 257 is rotatably supported around the axial line of the shaft 258, so as to be able to move in the direction of the arrows F1, F2 in a state of elastically abutting against the inner side 256 of the cover plate 231, depending on the angular dislocation in the direction of arrows D1, D2 of the cover plate 231. The dislocation of such roller 257 in the direction of arrow F2 is arrested by abutting against a stopper 259 fixed on the inner side 256 of the cover plate 231. The spring 218 is located downstream, in the direction of arrow F2, from the stopper 259, as indicated by virtual line 218*c*, in the natural state. Therefore, when its spring 218 is at specified position (solid line), a specific force is already applied to the cover plate, and the magnitude of the thrusting force at this time is determined by the spring material and shape, or it is set at a strength sufficient to withstand a predetermined wind pressure. At the downstream side in the direction of arrow F2 of the inner side 256 of the cover plate 231, a protuberance 260 is formed, and an engaging piece 262 to be engaged with one end of the coil 261 is fitted to the protuberance 260. This engaging piece 262 is held by a pair of holding pieces 263, 264, and is affixed to the protuberance 260 by a bolt 265 and a nut 266 screwed therein. The other end of the coil 261 is inserted and stopped in the insertion hole 267 formed in the coupling part 207 of the base 205. The length of such soil 261 is selected so as to be stretched taut when the angle $\theta$, to the surface 202 of the cover plate 231, elastically pressed in the direction of arrow D2 by spring 218, is 45°. This angle can be selected freely. Meanwhile, the spring force of the spring 218 may be adjusted by moving the spring 218 vertically in FIG. 7 along the slot 219 by loosening the nut 257. The spring force of the spring 218 is adjusted at the shop.

In the cover plate 231, moreover, an engaging hole 268 in an almost semi-arc shape is formed, and soft or hard vinyl chloride packings 271, 272 are fitted in the engaging hole 268. To the packings 271, 272, a cover plate 231*a* partly fitted in the engaging hole 268 near the free end portion is fitting. While the free end portion of the cover plate 231*a* is fitting to the packings 271, 272 in this way, the packings 271, 272 are thrust in the direction of arrow D2 through the cover plate 231 by the spring force of the spring 218, so that the packings 271, 272 are elastically abutting against the end face 273 of the free end portion of the cover plate 231*a*. Consequently, invasion of wind or rainwater from the direction indicated by reference numeral 274 into the inner side of the cover plates 231, 231*a* can be securely prevented.

When mounting the cover plate 231 on the body 201, the base 205, spring 218 and cover plate 231 are assembled on the supporting member 208 at the shop, and the assembly is brought to the site with the spring force of the spring 218 being adjusted, and a stud bolt 224 projecting to the inner side of the gap L is inserted into the slot 221 and insertion holes 222, 223 through the liner 204 disposed on the surface 202. The nut 226, is tightened and the supporting member 208, base 205 and cover plate 231 with the spring 218 and coil 261 mounted thereon are fitted, and then the upper cover 246 is put on, and the backup material 252 and seal material 253 are charged to finish the mounting work. The other cover plate 231*a* is similarly mounted on the surface 202*a* of the body 201*a* in the same structure as the cover plate 231, and the corresponding parts are identified with the subscript a, and the repeated explanation is omitted.

At the inner side (lower side in FIG. 7) of the gap L of the cover plates 231, 231*a*, a water stop 277 made of neoprene rubber or other materials arranged. Both ends of the water stop 277 are fixed to cover bodies 278, 278*a* made of aluminum, and the cover bodies 278, 278*a* are fixed to brackets 280, 280*a* by screws 279, 279*a*. These brackets 280, 280*a* are fixed by tightening nuts 283, 283*a* on stud bolts 282, 282*a* planted on the bodies 201, 201*a*, respectively. Grooves 284, 284*a* between the cover bodies 278, 278*a* and surfaces 202, 202*a* are filled up with backup materials 285, 285*a*, and seal material 286, 286*a*, so that water tightness is achieved. By installing the water stop 277, as mentioned later, even if a clearance is produced between the cover plates 231, 231*a*, invasion of wind and rain into the inner side of the gap L may be securely prevented.

Figure 9:
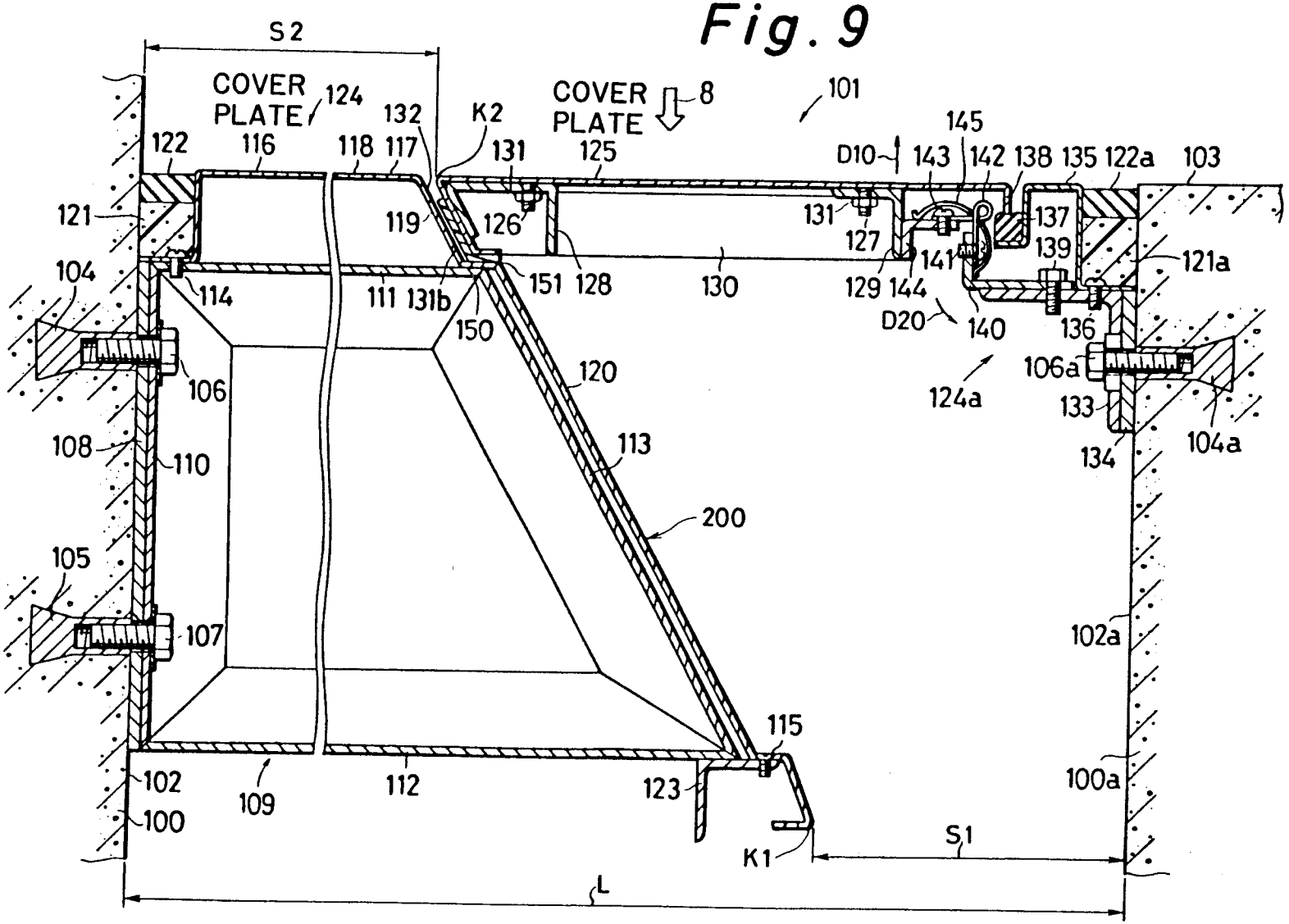
FIG. 9 is a horizontal sectional view of a further different embodiment of the invention, and FIGS. 10(1), 10(2) and 10(3) are views explaining the operation of the embodiment shown in FIG. 9.

FIG. 9 is a horizontal sectional view of a further different embodiment of the invention. Between bodies 100, 100*a* disposed at a gap L, an expansion joint apparatus 101 is disposed. An inner surface 102 of the body 100 is extended in the vertical direction in FIG. 9, and an outer surface 103 bent nearly at a right angle is continuous to the inner surface 102*a* of the body 100*a*. Nuts 104, 105 are buried in the body 100, and bolts 106, 107 are fitted to these nuts 104, 105. By these nuts 104, 105 and bolts 106, 107, a bracket 109 is fixed to the body 100 by way of an iron-made liner 108.

This bracket 109, in which a bolt insertion hole for inserting bolts 106, 107 is formed, comprises a frame member 110 which is fixed to the body 100 by abutting against the liner 108, frame members 111, 112 fixed to the both ends of the frame member 110 by welding, and a frame member 113 fixed to the frame members 111, 112 by welding. Such a bracket 109 is disposed at a spacing in the vertical direction of the sheet of the paper in FIG. 9. The frame members 110 to 113 composing the bracket 109 are made of, for example, equal angle steels. To such bracket 109, a metallic cover plate 116 of aluminum or other material is fitted by means of bolts 114, 115. This cover plate 116 possesses a cover part 118 having a surface 117 nearly flush to the outer surface 103 of the body 100*a*, a first inclination part 119 continuous to the cover part 118, a step difference part 150 continuous to the first inclination part 119, and a second inclination part 120 continuous to the step difference part 150.

By the first inclination part 119, step difference part 150 and second inclination part 120, a support block 200 is composed. These inclination parts 119, 120 are inclined in the direction of approaching the body 110 to which the cover 116 is fitted, as going from the inner side to the outer side of the gap L, that is, in the direction reverse to the arrow 8. Hence, when the gap L becomes narrow as mentioned below, a front end 125*a* of a cover plate 125 elastically abutting against the step difference part 150 by the force of a spring 145 is guided along the guide surface 132 of the first inclination part 119, and is dislocated angularly at a outer side of the gap L about the hinge 142, that is, in the direction of arrow D10, so that the front end part 125*a* rides on the cover part 18. Besides, when the gap L is widened, by the spring force of the spring 145, the cover plate 125 is angularly dislocated in the direction of the inner side of the gap L about the hinge 142, that is, in the direction of the arrow D20, and the front end part 125*a* can move to the inner side of the gap L along the second inclination part 120. Therefore, end portion K1 of the body 100*a* closest to the second inclination part 120 composing the support block 200 of the cover plate 125 and the inner surface 102*a* are spaced at a distance of S1, while an end portion K2 of the body 100 closest to the front end part of the cover plate 125 and the inner surface 102 are spaced at a distance of S2. These distances S1, S2 are nearly equal to each other (S1=S2), and therefore the bodies 100, 100*a* are dislocatable within a range of distances S1, S2.

Between the cover part 118 and the inner surface 102 of the body 100, a backer 121 made of foamed synthetic resin material such as polyethylene is placed, and at the outer side of the backer 121 (in the upper part of FIG. 9), a seal material 122 having adhesiveness, such as a silicone seal, is charged. The lower side end portion in FIG. 9 of the second inclination part 120 is fixed to a longitudinal support member 123, which is fixed by welding to the bracket 109 by means of bolt 115.

On the support surface 150 of the supporting member 124 composed in this manner, the free end portion of the cover plate 125 is supported. Bolts 126, 27 are fixed to the cover plate 125 by spot welding or other means, and reinforcing members 128, 129 forming bolt holes for bolts 126, 127 are fixed by nuts 131. To these reinforcing members 128, 129, reinforcing member 130 stretching parallel to the sheet of paper of FIG. 9 is fixed by welding.

On the surface of the cover plate 123 opposite to the first inclination part 119, a cushion piece 131 made of synthetic resin material excellent in slipping performance such as tetrafluoroethylene known by the brand-name of Teflon or the like is adhered with adhesive. By installing such cushion piece 131*h*, the cover plate 125 is smoothly guided along a guide surface 132 included on the first inclination part 119, so that angular dislocation in the direction of arrow D10 is realized.

The base end portion of the cover plate 125 is supported by the supporting member 124*a* so as to be angularly dislocatable. A nut 104*a* is buried in the body 100*a*, and a bolt 106*a* is screwed into the nut 104*a*. By the nut 104*a* and bolt 106*a*, a bracket 133 is fixed across a liner 134. A cover piece 135 is fixed to the bracket 133 by bolt 136. In the recess formed by the cover piece 135 and inner surface 102*a* of the body 100*a*, a joint sealer 121*a*, made of the same material is the joint sealer 121, is fitted, and above the joint sealer 121*a* (in FIG. 9) a seal material 122*a* made of the same material as the seal material 122 is fitted. At the free end portion of the cover piece 135, a packing 137 is fixed with adhesive or the like. To this packing 137, a bent edge portion 138 of the cover plate 125 is fitted, and invasion of wind and rainwater from the direction indicated by reference numeral 8 is prevented.

An L-shaped mounting member 140 is fixed to the bracket 133 by means of bolt 139, and one end of a hinge 142 is fixed to the mounting member 140 by a bolt 141. The other end of the hinge 142 is fixed to a mounting member 144 fixed to the reinforcing member 129 by welding by means of a bolt 143. By this hinge 142, the cover plate 125 is thrust in the direction of arrow D20. This hinge 142 is fitted with a spacing in the direction vertical to the sheet of paper in FIG. 9. In the hinge 142, a spring 145 is placed between the mounting members 140 and 144. By this spring 145, the cover plate 125 is thrust with spring in the direction of arrow D20. At the inner side of the gap L of such expansion joint apparatus 101 (the lower part of FIG. 9), a water stop 201 is disposed as shown in FIG. 2.

In the expansion joint apparatus 101 having such structure, when the bodies 100, 100*a* are changed by an earthquake or the like in a manner to narrow the gap L, the cover plate 125 is guided by the guide plane 132 of the inclination part 119, and is pushed up in the direction of the arrow D10 by resisting the elastic force of the hinge 142 and spring 145. Besides, when changed in a manner to widen the gap L, the cover plate 125 is guided along the inclination part 120 as the intervening plate 131*b* abuts against the bent part 151 of the cover plate 125, so as to be dislocated angularly in the direction of arrow D20. Thus, when the gap L changes momentarily, it is possible to allow the change of the gap L while filling up the gap, and invasion of wind or rainwater in the direction indicated by reference numeral 8 can be prevented.

Figure 10:
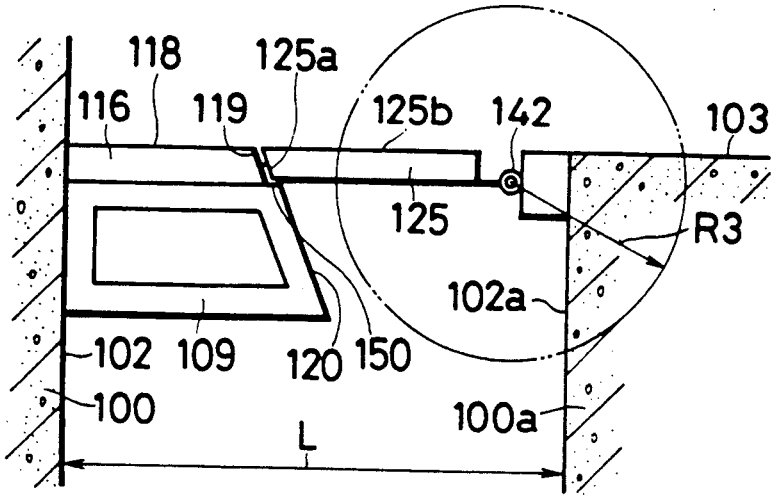
Figure 10:
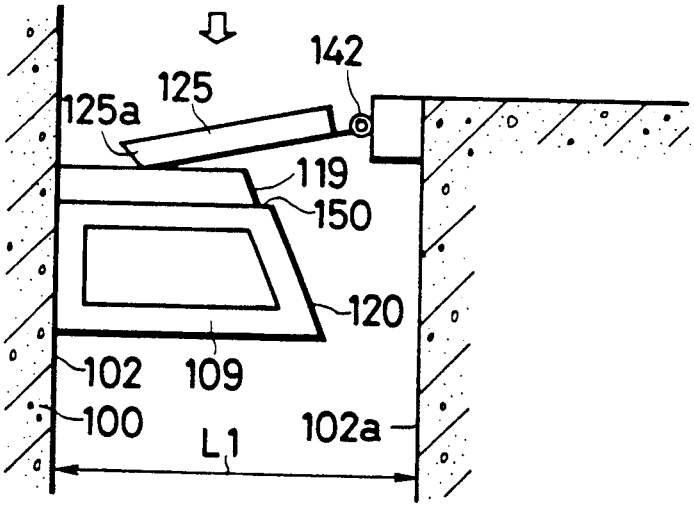
Figure 10:
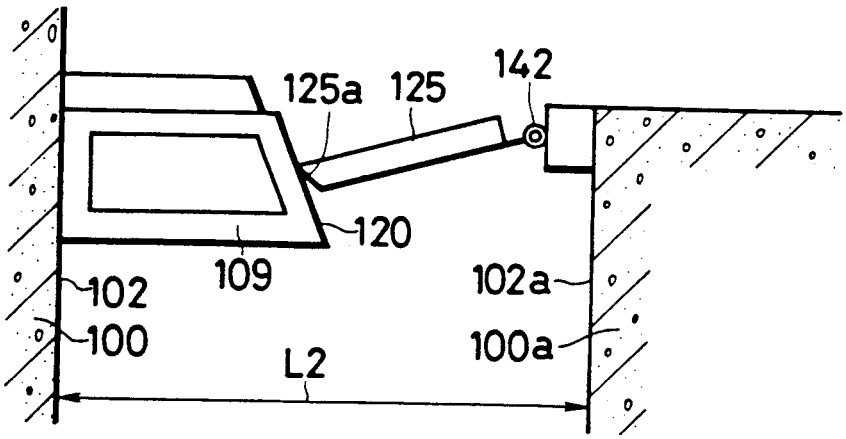

FIG. 10 is a simplified sectional view showing the moving range in a different embodiment. First as shown in FIG. 10(1), while the bodies 100, 100*a* are mutually spaced at a gap L, the front end part 125*a* of the cover plate 125 is supported by the step difference part 150, and the outer surface 103 of the body 100*a* nearly vertical to the inner surface 102 of the body 100, the outer surface 125*b* of the cover plate 125, and the outer surface 117 of the cover part 118 of the other cover plate 116 roughly form a flat plane. From such state shown in FIG. 10(1), when the bodies 100, 100*a* approach relatively and the body 100*a* is dislocated to the other side, and when the gap L changes to a relatively small gap L1 as shown in FIG. 10(2), the front end part 125*a* of the cover plate 125 is guided by the inclination part 119, and the cover plate 125 is angularly dislocated to the outer side (in the direction of arrow D10) about the hinge 142, and is supported on the cover part 118, in a state elastically abutting by the spring force of the spring 145. Therefore, wind and rain will not invade into the space inside of the gap directly from the direction of the reference numeral 8, and the gap is kept filled up.

Meanwhile, when the bodies 100, 100*a* are relatively spaced and the body 100*a* is dislocated to the inner side (in the direction of arrow D20) to change the gap L to a relatively large gap L2 as shown in FIG. 10(3), the front end portion 125*a* of the cover plate 125 is dislocated angularly in the direction of arrow D20 while being guided by the inclination part 120, and is supported in a state elastically abutting against the guide surface 120. Even in such a state, the relatively wide gap L2 may be kept filled up. Such dislocation the bodies 100, 100*a* is possible in a range of satisfying the equations(1) and (2) below in the mutually approaching and departing directions; that is, when the dislocation only in the lateral direction in FIG. 10 is taken into consideration.

$$L-L1=S2 \quad (1)$$

$$L2-L=S1 \quad (2)$$

Besides, considering the dislocation in the longitudinal direction of the bodies 100, 100*a*, that is, the dislocation also including that in the vertical direction in FIG. 10, the dislocation is possible within a moving range of the hinge 142 within the virtual circle of the radius R3 shown in FIG. 10(1).

In this case, too, it is possible to return to the original position smoothly as the front end portion 125*a* of the cover plate 125 slides on the inclination part 120. In the foregoing embodiment, when the gap L is narrow, the cover plates slide on each other by the spring action in a closing direction, or when the gap is widened, since the angular dislocation is restrained, a gap is opened between the cover plates. Accordingly, as shown in FIG. 2, a water stop 201 is disposed inside of the cover plate. The water stop 201 is made of neoprene rubber or butyl rubber sheet, and its both ends are held by the holding members 205, 205*a* in the mounting parts 206, 206*a* projecting from the brackets 203, 203*a* fitted to the bodies 100, 100*a* by bolts 203, 203*a*, and are fixed by screws 204, 204*a*. Such water stop 201 should have a sufficient deflection so as to be capable of following up the movement of the bodies 100, 100*a* in FIG. 10(2) and FIG. 10(3).

Incidentally, an important feature of the invention is that all units are installed with the gap L, and as compared with the conventional structure, greater width than the gap L is not needed, and the appearance looks very neat. Besides, the mounting position is not limited as far as within the gap L, whether at the surface side or at the deeper side, and the outer surface may be also matched with the finished surface of the body. Hence, it is easy to install in a large-scale building, a high-rise building, and other applications where a very wide gap is needed, and hence it is very effective in such applications.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claim is:

1. A joint for mounting on vertical surface of structural bodies for filling a gap between said structural bodies, said joint apparatus comprising:

a pair of cover plates disposed on vertical surfaces of respective said structural bodies, said structural bodies having a gap therebetween and said cover plates extending across said gap, wherein each said cover plates is mounted on a respective hinge for pivotal movement thereabout and each said cover plate is inclined such that said cover plates together form a substantially V-shaped configuration in section in a contact position;

a spring on each said cover plate for pivotally biasing its respective said cover plate toward the other said cover plate about the respective said hinge such that the ends of said cover plates can approach each other; and means for limiting the amount of angular pivotal movement of each said cover plate about its respective said hinge.

2. A joint apparatus as set forth in claim 1, wherein:

each said hinge has a supporting member connecting said hinge to a respective said vertical surface.

3. A joint apparatus as set forth in claim 2, wherein:

each said supporting member has a support part fixed to a respective said vertical surface and an engaging part extending toward the outside of said gap;

each said spring is fixed to said support part of said supporting member at one end of said spring, the other end of said spring elastically abutting against its respective said cover plate to pivotally thrust said cover plate toward the outside of said gap about the respective said hinge.

4. A joint apparatus as set forth in claim 3, wherein:

each said supporting member has a side facing toward the outside of said gap each said supporting member further comprises a fitting piece connected to said supporting part facing toward the outside of said gap, said cover plate being connected to said fitting piece by said hinge.

5. A joint apparatus as set forth in claim 1, wherein:

said means for limiting the amount of angular pivotal movement of said cover plate limits angular pivotal movement each said cover plate in a direction toward the outside of said gap to an inclination angle almost equal to the angles of said respective cover plates in said contact position.

6. A joint apparatus as set forth in claim 5, wherein:

said means for limiting the amount of angular pivotal movement of each said cover plate comprises a chain for said cover plate connected between an inner side of said cover plate and said vertical surface of said structural body.

7. A joint apparatus as set forth in claim 1, wherein:

one of said cover plates has a stopping groove therein, said stopping groove having a packing for receiving the front end of the other said cover plate thereagainst.

8. A joint apparatus as set forth in claim 7, wherein:

said front end of the other said cover plate is arc shaped.

9. A joint apparatus as set forth in claim 8, wherein:

a cover is fitted to each said supporting member facing outwardly of said gap, said cover defining a step portion adjacent said vertical surface of said body.

10. A joint apparatus as set forth in claim 9, wherein:

said step portion of said cover has a sealing material therein.

11. A joint apparatus as set forth in claim 1, wherein:

said spring is fixed to said vertical surface at a base end thereof and continuously curves away from said base portion and said vertical surface in a direction inwardly of said gap; and a free end of said spring slidably engages the inner surface of said cover plate.

12. A joint apparatus for mounting on vertical surfaces of structural bodies for filling a gap between said structural bodies, said joint apparatus comprising:

a pair of cover plates disposed on vertical surfaces of respective said structural bodies;

at least one of said cover plates having a hinge connected thereto for mounting said cover plate to its respective said vertical surface; and means for pivotally biasing said at least one cover plate about said hinge in a direction inwardly of said gap.

13. A joint apparatus as set forth in claim 12, wherein:

one said cover plate comprises a cover portion;

said structural body of the other said cover plate has an outer surface adjacent thereto;

said cover portion of said one cover plate is substantially flush with said outer surface of the other said cover plate; and said one cover plate has a support portion continuous with said cover portion and inclined inwardly of said gap and toward said vertical surface of the other said cover plate.

14. A joint apparatus as set forth in claim 13, wherein:

said support part comprises a first inclined portion continuous with said cover, a step portion continuous with said first inclined portion and extending toward said vertical surface of the other said cover plate and a second inclined portion continuous with said step portion.

15. A joint apparatus as set forth in claim 13, wherein:

said support portion has an extreme end portion which is closest to and spaced a first distance from said vertical surface of the other said cover plate and an extreme end portion at a front end of the other said cover plate is spaced a second distance from said vertical surface of said one cover plate.

16. A joint apparatus as set forth in claim 12, wherein:

each of said cover plates is disposed on a respective supporting member, and said supporting members are fixed to respective said vertical surfaces inwardly of said cover plate with respect to said gap.

* * * * *